US008857907B2

(12) United States Patent
Nagamitsu

(10) Patent No.: US 8,857,907 B2
(45) Date of Patent: Oct. 14, 2014

(54) MASSAGE MACHINE

(75) Inventor: Tomoki Nagamitsu, Tottori (JP)

(73) Assignee: Family Inada Co., Ltd., Osaka (JP)

( * ) Notice: Subject to any disclaimer, the term of this patent is extended or adjusted under 35 U.S.C. 154(b) by 102 days.

(21) Appl. No.: 13/618,416

(22) Filed: Sep. 14, 2012

(65) Prior Publication Data

US 2013/0088059 A1 Apr. 11, 2013

(30) Foreign Application Priority Data

Oct. 6, 2011 (JP) ..... 2011-221460

(51) Int. Cl.

| | |
|---|---|
| ***A47C 3/02*** | (2006.01) |
| ***A61H 1/00*** | (2006.01) |
| *A61H 7/00* | (2006.01) |
| *A61H 9/00* | (2006.01) |

(52) U.S. Cl.

CPC ..... *A61H 1/003* (2013.01); *A61H 2201/1436* (2013.01); *A61H 2201/1669* (2013.01); *A61H 2201/5064* (2013.01); *A61H 2201/1463* (2013.01); *A61H 2201/1633* (2013.01); *A61H 2201/5002* (2013.01); *A61H 2201/0149* (2013.01); *A61H 7/007* (2013.01); *A61H 2201/1215* (2013.01); *A61H 2205/081* (2013.01); *A61H 2201/1676* (2013.01); *A61H 9/0078* (2013.01); *A61H 2205/088* (2013.01); *A47C 3/02* (2013.01); *A61H 2201/5007* (2013.01); *A61H 2205/10* (2013.01)

USPC ..... 297/260.2; 297/260.3; 297/271.1; 297/271.4; 297/217.4

(58) Field of Classification Search

USPC ..... 297/217.4, 260.1, 260.2, 260.3, 271.1, 297/271.4, 273

See application file for complete search history.

(56) References Cited

U.S. PATENT DOCUMENTS

| | | | | |
|---|---|---|---|---|
| 3,758,156 | A * | 9/1973 | Zawadzki | 297/260.2 |
| 5,143,055 | A * | 9/1992 | Eakin | 297/217.4 X |
| 5,368,359 | A * | 11/1994 | Eakin | 297/217.4 |
| 5,792,082 | A * | 8/1998 | Yamanaka et al. | 601/148 |
| 6,152,529 | A * | 11/2000 | Beason | 297/260.2 |
| 7,350,864 | B1 * | 4/2008 | Brewster | 297/260.2 X |
| 7,455,359 | B2 * | 11/2008 | Ronning | 297/271.4 X |
| 7,794,014 | B2 * | 9/2010 | Beall et al. | 297/217.4 |
| 7,866,747 | B2 * | 1/2011 | Park | 297/217.4 |
| 8,113,517 | B2 * | 2/2012 | Canterbury et al. | 297/217.4 X |
| 8,177,296 | B2 * | 5/2012 | Shih | 297/260.2 X |
| 8,616,627 | B2 * | 12/2013 | Murphy et al. | 297/271.1 X |
| 2008/0054561 | A1 * | 3/2008 | Canterbury et al. | 297/217.3 X |
| 2008/0185888 | A1 * | 8/2008 | Beall et al. | 297/217.4 |
| 2009/0189424 | A1 * | 7/2009 | Chi | 297/217.4 |
| 2010/0205867 | A1 * | 8/2010 | Park | 297/217.4 X |
| 2010/0320819 | A1 * | 12/2010 | Cohen et al. | 297/217.4 |
| 2012/0212022 | A1 * | 8/2012 | Godbout et al. | 297/260.2 |
| 2012/0216347 | A1 * | 8/2012 | Tundo et al. | 297/260.2 X |

* cited by examiner

*Primary Examiner* — Rodney B White

(74) *Attorney, Agent, or Firm* — Rader, Fishman & Grauer PLLC

(57) ABSTRACT

A massage machine that can stably rock a chair main body in a forward-backward direction and that has minimal overall height comprising a chair main body, a base which supports the chair main body, massage portions provided in the chair main body, and a rocking mechanism portion which rocks the chair main body in the forward-backward direction with respect to the base. The rocking mechanism portion includes link members, each of which has a lower portion pivotally supported by the base and an upper portion pivotally supporting the chair main body. The chair main body is rocked in the forward-backward direction by rocking the upper portions of the link members in the forward-backward direction.

12 Claims, 12 Drawing Sheets

MASSAGE MACHINE

CROSS REFERENCES TO RELATED APPLICATIONS

This application claims priority from Japanese Patent Application Serial No. 2011-221460 filed Oct. 6, 2011, the contents of which are incorporated herein by reference in its entirety.

BACKGROUND

The present invention relates to a massage machine suitable for rocking a chair main body in a forward-backward direction.

Conventionally, a massage machine has been known, in which a movable frame and a fixed frame are coupled to each other, a seat portion and a backrest portion are attached to the moveable frame, and a pivot point is set at a fulcrum Such a massage machine is capable of rocking the movable frame in the forward-backward direction about the pivot point with respect to the fixed frame by driving a rocking drive unit with a motor (see FIGS. 4 and 5 in Japanese Unexamined Patent Application Publication No. 2011-72595, for example).

In addition, another massage machine has also been known, in which a supported portion and a base portion are coupled to each other with two front and back links, a seat portion and a backrest portion are attached to the supported portion, and which is capable of rocking the supported portion in the forward-backward direction with respect to the base portion (see FIG. 14 in Japanese Unexamined Patent Application Publication No. 11-137626, for example).

According to the massage machine disclosed in JP 2011-72595, however, a movable frame 11 (chair main body) is supported by a fixed frame 10 (base) while only a pivot point A2 is set to a movable portion, and therefore, the load of a user is concentrated and acts on the movable portion. Therefore, excessive load acts on the rocking mechanism portion, and there is a problem in that smooth rocking motion of the movable frame is prevented when the movable frame is rocked.

On the other hand, in the massage machine disclosed in Japanese Patent Application Publication No. 11-13762, since both front and back ends of a supported portion 56 (chair main body) are coupled to a base portion 5 (base) with two links 54 and 54, the load of a user acts on the movable portion (coupling portions 55 and 55 between the supported portion and the base portion) of the supported portion 56 with respect to the base 5 and is distributed in the forward-backward direction. Therefore, less load acts on the rocking mechanism portion during the rocking of the supported portion 56, and it is possible to smoothly rock the supported portion 56.

However, since the massage machine disclosed in Japanese Patent Application Publication No. 11-137626, is configured such that a lower end of the link 54 is coupled to the supported portion 56 (chair main body) and an upper end of the link 54 is coupled to the base portion 5 (base), it is necessary to locate the coupling portion to the link 54 in the base portion 5 at a higher position than a floor surface, and there is a problem in that the height of entire massage machine becomes larger.

Thus, the present invention has been made in order to solve the aforementioned problems, and an object thereof is to provide a massage machine, which is capable of stably rocking a chair main body in the forward-backward direction, the overall height of which is suppressed.

BRIEF SUMMARY OF THE INVENTION

According to the present invention, there is provided a massage machine including: a chair main body including a seat portion on which a user is seated and a back rest portion which is provided behind the seat portion; a base which supports the chair main body; a massage portion which is provided in the chair main body to perform massage on a body of the user; and a rocking mechanism portion which rocks the chair main body in a forward-backward direction with respect to the base, wherein the rocking mechanism portion includes link members, each of which has a lower portion pivotally supported by the base and an upper portion pivotally supported by the chair main body, wherein each link member includes a first link portion and a second link portion positioned behind the first link portion, and wherein the chair main body is rocked in the forward-backward direction by rocking the upper portions of the link members in the forward-backward direction. With such a configuration, the chair main body is supported by the base via the first and second link portions provided in the forward-backward direction, and, therefore, it is possible to distribute the load working on the rocking mechanism portion in the forward-backward direction and thereby to stably rock the chair main body in the forward-backward direction. In addition, since the lower portions of the link members are coupled to the base, and the upper portions of the link members are coupled to the chair main body, it is not necessary to locate the coupling portions of the link members in the base at a position which is higher than the floor surface, and it is possible to suppress a height of the entire massage machine.

In addition, it is preferable that the chair main body include an accommodating portion, which accommodates at least a part of the rocking mechanism portion inside the chair main body, to which the link members are attached. With such a configuration, fewer parts of the rocking mechanism portion are exposed outside of the chair main body, and it is possible to enhance aesthetic appearance.

In addition, it is preferable that the rocking mechanism portion include a rocking drive unit which rocks the link members. With such a configuration, it is possible to forcibly rock the chair main body in the forward-backward direction by driving the rocking drive unit.

In addition, it is preferable that the rocking drive unit include a motor, a decelerator whose output shaft is rotated by rotation of the motor, and a converter which converts rotational movement of the output shaft into reciprocating rocking motion in the forward-backward direction of the link members, and that the converter include a rotational member which is rotatable integrally with the output shaft, an eccentric shaft which is attached to the rotational member, and a crank member which is provided between the eccentric shaft and the base. With such a configuration, it is possible to sequentially reciprocate and rock the chair main body in the forward-backward direction by sequentially rotating the motor in one direction.

In addition, it is preferable that the chair main body include a footrest which is provided in front of the seat portion such that the footrest is turnable in the vertical direction, that the chair main body be configured such that a front portion of the seat portion moves upward in accordance with forward movement and a front portion of the seat portion moves downward in accordance with backward movement, and that the footrest be configured to be turned upward in accordance with the forward movement of the chair main body. With such a configuration, the legs are stretched as they move to a higher position, and therefore, it is possible to promote the blood flow in the legs to be directed to the heart as in a so-called centripetal method and thereby to enhance a relaxing effect.

In addition, it is preferable that the massage machine further include foot link members which vertically turn the footrest in accordance with movement of the chair main body in the forward-backward direction and that the footrest be connected to the link members via the foot link members. With such a configuration, it is not necessary to separately provide a drive source for vertically turning the footrest.

In addition, it is preferable that a configuration be made such that the first link portions are coupled to the rocking drive portion and the second link portions follow operations of the first link portions, and that the foot link members be pivotally supported by the first link portions. With such a configuration, the load from the legs acts on the footrest, the drive force of the rocking drive unit is directly delivered to the first link portions since the rocking drive unit is coupled to the first link portions to which the foot link members are coupled, and it is possible to smoothly rock the chair main body in the forward and backward direction and turn the footrest in the vertical direction.

According to the present invention, it is possible to stably rock the chair main body in the forward-backward direction and suppress the height of entire massage machine.

DETAILED DESCRIPTION

1. First Embodiment

Overall Configuration

Figure 1:
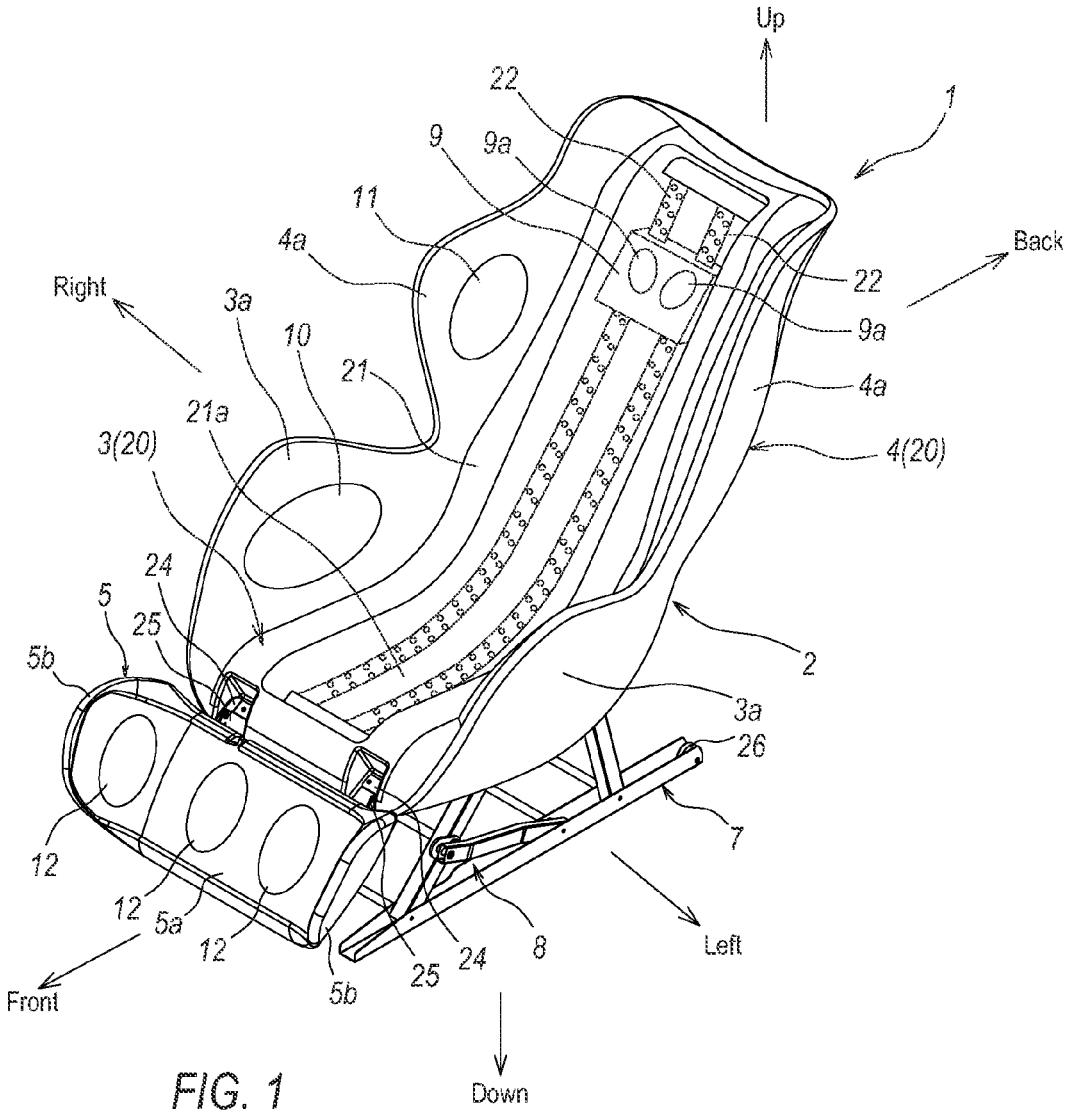
FIG. 1 is a perspective view of a massage machine.
Figure 2:
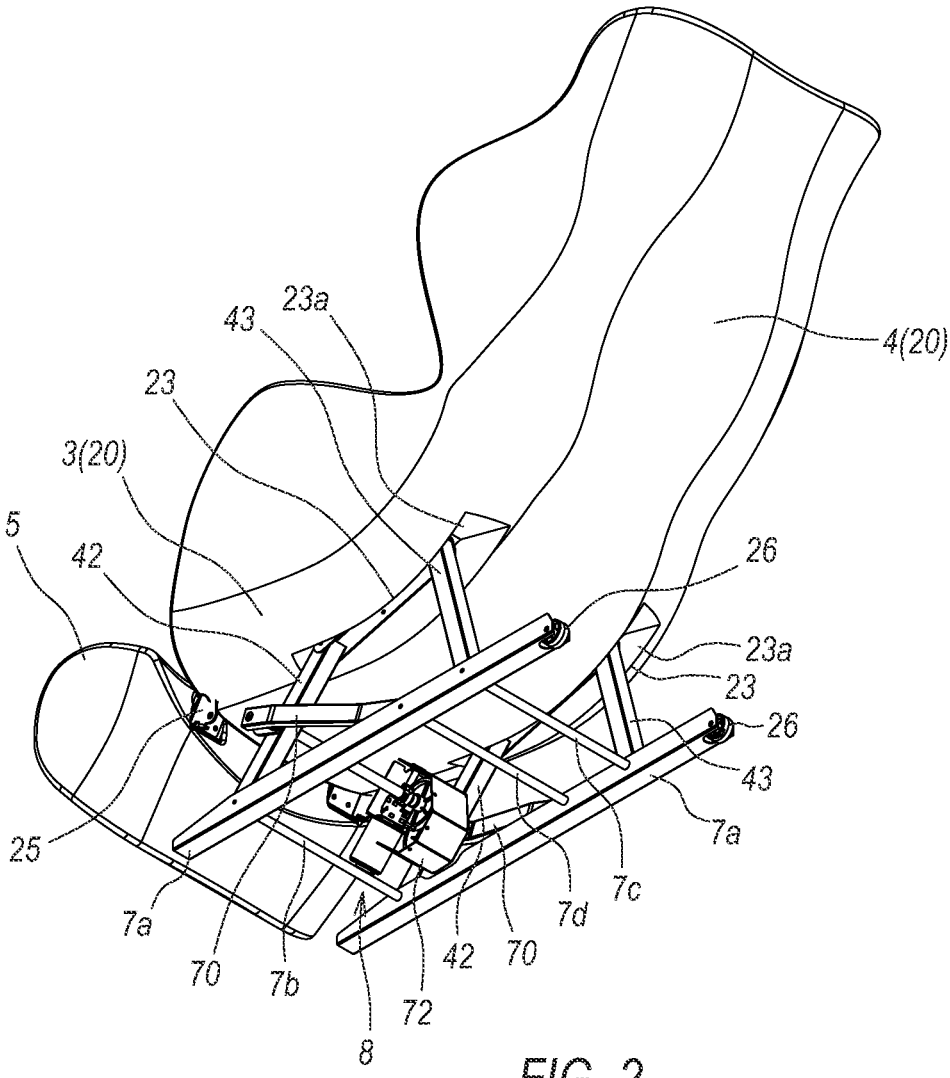
FIG. 2 is a perspective view of a massage machine.
Figure 3:
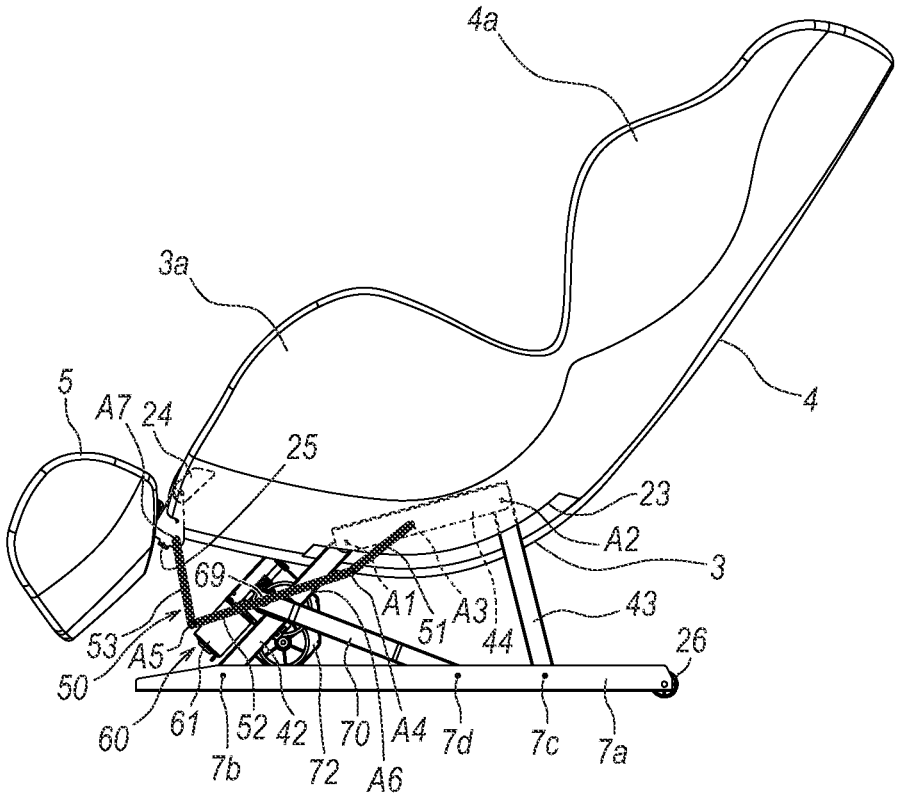
FIG. 3 is a side view of a massage machine in a standing state.
Figure 4:
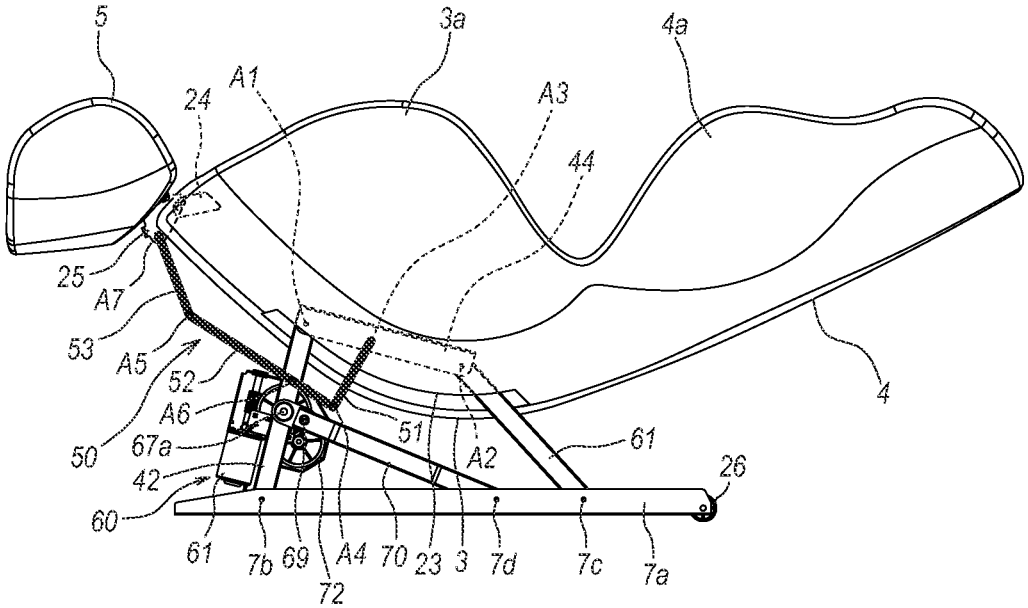
FIG. 4 is a side view of a massage machine in a reclining state.
Figure 5:
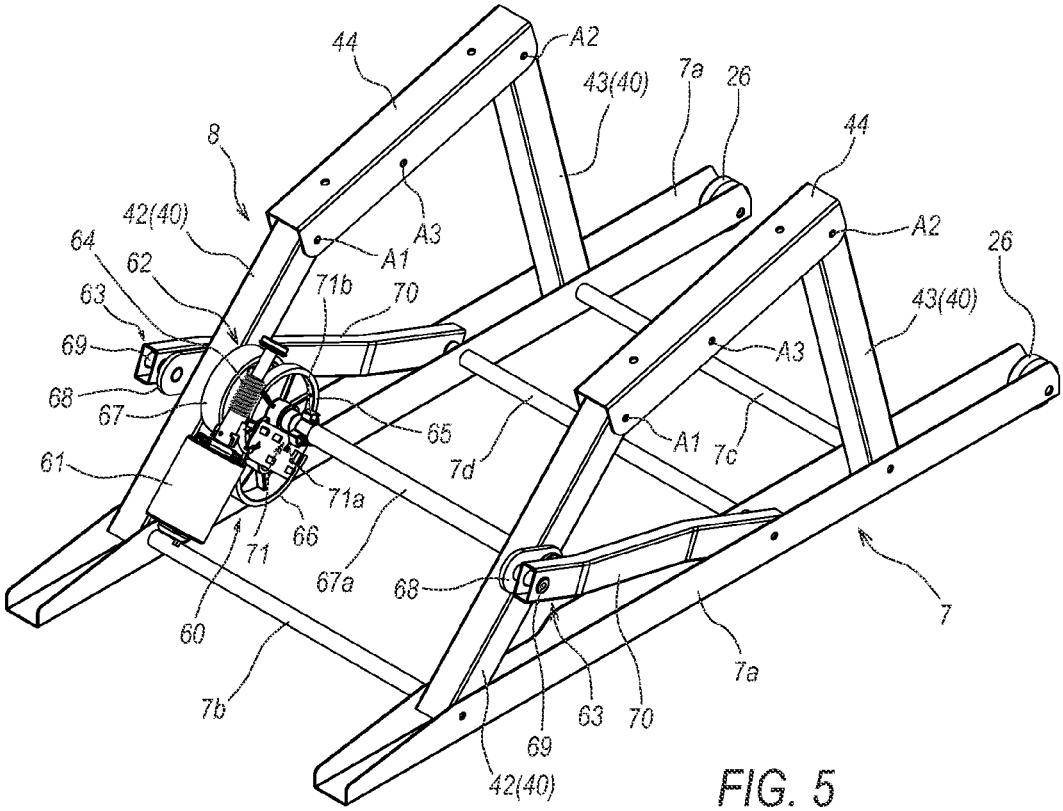
FIG. 5 is a perspective view showing a base and a rocking mechanism portion.
Figure 6:
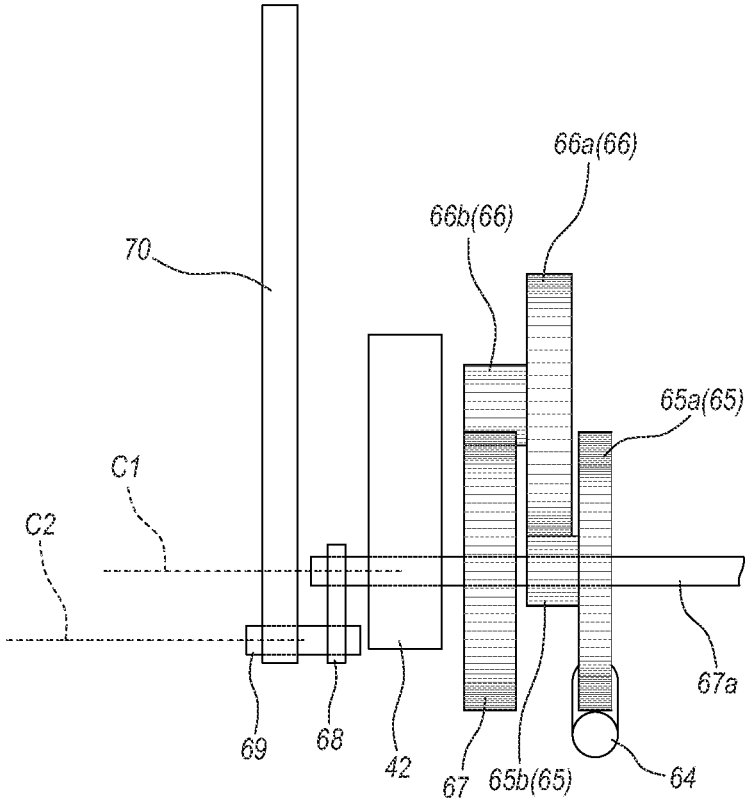
FIG. 6 is an explanatory diagram for illustrating the rocking mechanism portion.
Figure 7A:
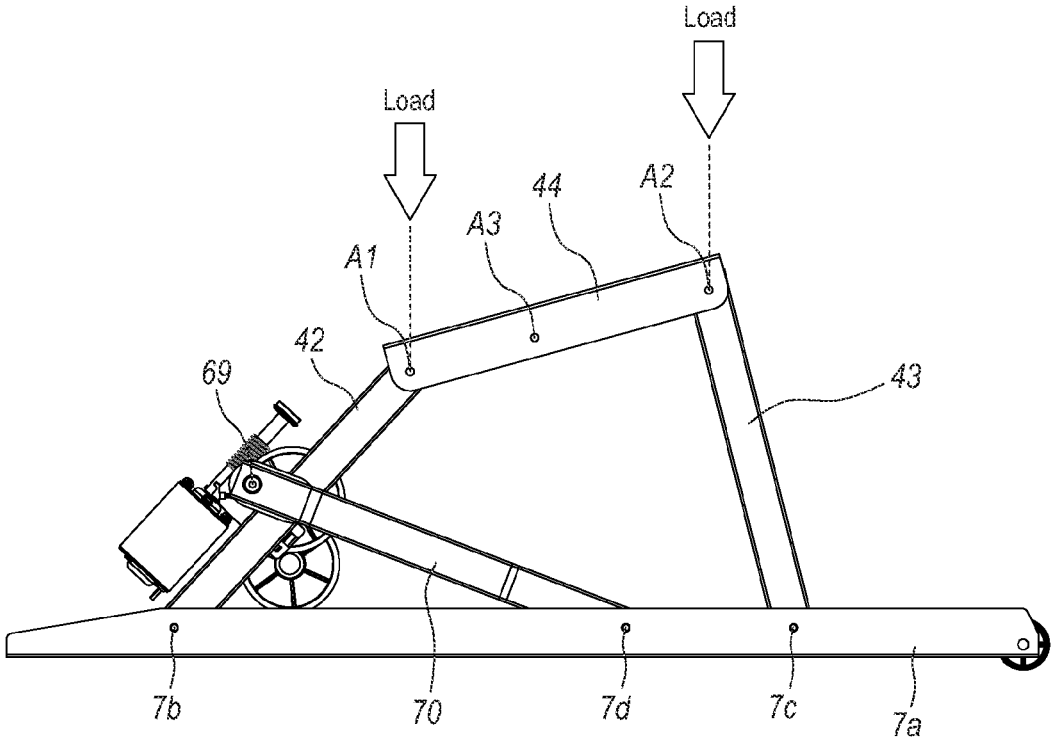
FIG. 7 is an explanatory diagram for illustrating operations of the rocking mechanism, where (a) shows the standing state, (b) shows an intermediate state, and (c) shows the reclining state, respectively.
Figure 7B:
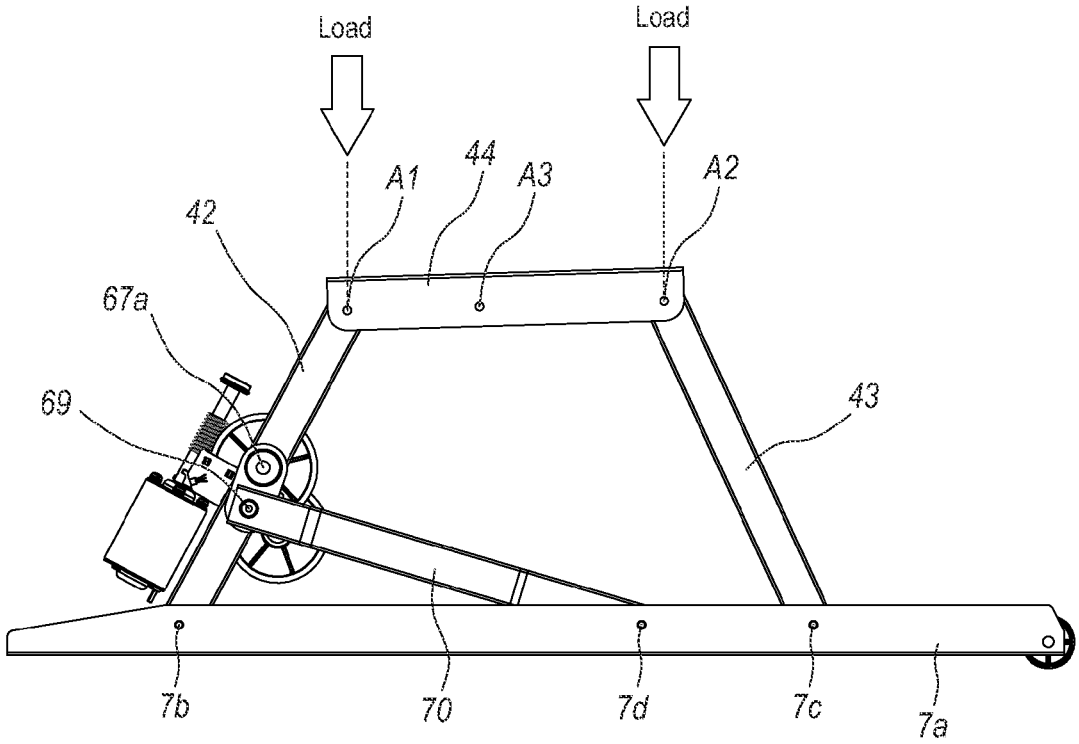
Figure 7C:
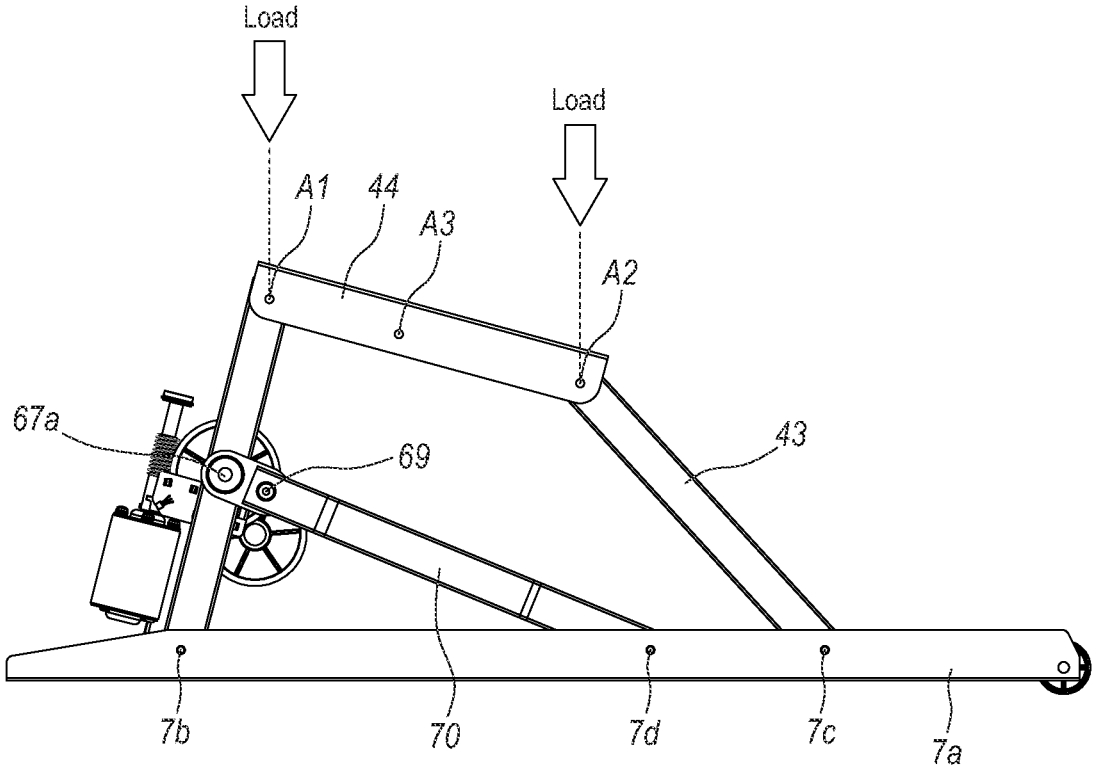
Figure 8:
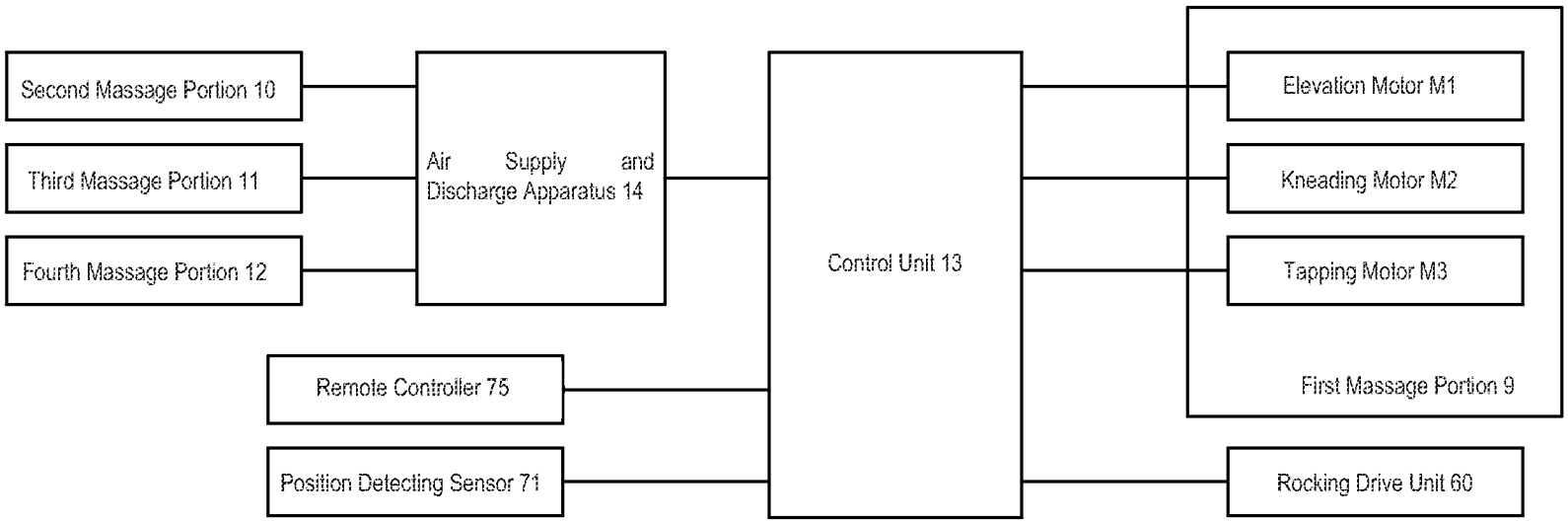
FIG. 8 is a functional block diagram of the massage machine.

Hereinafter, description will be given of an overall configuration of a massage machine 1 according to a first embodiment of the present invention. FIG. 1 is a perspective view of the massage machine 1 according to the first embodiment of the present invention. FIG. 2 is a perspective view of the massage machine when viewed from a direction which is different from the direction in FIG. 1. FIG. 3 is a side view of the massage machine 1 in a standing state. FIG. 4 is a side view of the massage machine 1 in a reclining state. FIG. 5 is a perspective view showing a base 7 and a rocking mechanism portion 8. FIG. 6 is an explanatory diagram for illustrating the rocking mechanism portion 8. FIG. 7 is an explanatory diagram for illustrating operations of the rocking mechanism portion 8, where (a) shows the standing state, (b) shows an intermediate state, and (c) shows the reclining state. FIG. 8 is a functional block of the massage machine 1. In addition, foot link members 50 which will be de described later are omitted in FIGS. 1 and 2 in consideration of visibility, and FIG. 6 is a diagram schematically showing the rocking mechanism portion 8 when viewed from an upper and obliquely back direction.

As shown in FIG. 1, the massage machine 1 of the present invention mainly includes a chair main body 2 comprising a seat portion 3 on which a user is seated, a backrest portion 4, which is integrally provided behind the seat portion 3, on which the user leans, and a footrest 5 which is provided in front of the seat portion 3 in a vertically rotatable manner so as to support the legs of the user. The massage machine 1 also includes a base 7, which supports the chair main body 2 so as to be able to rock the chair main body 2 in the forward-backward direction and is installed on a floor surface, a rocking mechanism portion 8 which rocks the chair main body in the forward-backward direction with respect to the base 7, and massage portions 9 to 12 which are provided in the chair main body 2 to perform massage on parts to be treated of the user.

In addition, directional concepts used in the following description are the same as those when viewed from the user seated on the massage machine 1 in the standing state as shown in FIG. 3, the left-hand side corresponds to "left", the right-hand side corresponds to "right", the side of a head corresponds to "up", the side of a lower back corresponds to "down", and description will appropriately be given in other cases.

Configurations of Seat Portion and Backrest Portion

The seat portion 3 and the backrest portion 4 are integrally formed to configure a first body supporting portion 20. The first body supporting portion 20 includes a first body supporting portion main body 21 with openings 21*a* which sequentially open to the front side from the seat portion 3 to the backrest portion 4 and a pad portion (not shown) which is disposed in front of the first body supporting portion main body 21 and has a stretching property.

The first body supporting portion 20 is provided a mechanical first massage portion 9 which can move up and down by being driven by an elevation motor M1 (see FIG. 8) via a guide mechanism 22 provided in the first supporting portion main body 21 within the openings 21*a* of the first body supporting portion main body 21 to sequentially perform massage on a thighs to a back of the user via the pad portion (not shown). The first massage portion 9 includes a pair of left and right treatment elements 9*a* and 9*a*, which can perform a kneading operation in which the pair of treatment elements 9*a* and 9*a* are made to move close to and away from each other in the horizontal direction, by being driven by a kneading motor M2 (see FIG. 8), and can perform a tapping operation in which the pair of treatment elements 9*a* and 9*a* are made to alternately move forward and backward in the forward-backward direction, by being driven by a tapping motor M3 (see FIG. 8). The driving of such motors M1 to M3 are performed by a control unit 13 (see FIG. 8) provided under the seat portion 3.

The seat portion 3 include a pair of left and right side walls 3*a* and 3*a* which face the outer surfaces from the hips to the thighs of the user, and pneumatic second massage portions 10, which perform massage on the hips to the thighs, are provided on the inner surfaces of the side walls 3*a*. The backrest portion 4 includes a pair of left and right side walls 4*a* and 4*a* which face the outer surfaces of upper arms of the user, and pneumatic third massage portions 11, which perform massage on the upper arms, are provided on the inner surfaces of the side walls 4*a*.

In addition, as shown in FIG. 2, containing portion 23 with containing grooves 23*a* opening downward so as to contain at least a part of the rocking mechanism portion 8 which will be described later is provided at the bottom of the first body supporting portion 20 (chair main body 2). The containing grooves 23*a* sequentially open from the seat portion 3 to the lower portion of the backrest portion 4 so as to prevent interference between the rocking mechanism portion 8 and the first body supporting portion 20 accompanying with the movement of the rocking mechanism portion 8.

Configuration of Footrest

As shown in FIG. 1, the footrest 5 includes a bottom wall 5*a*, on which the legs of the user are placed, a pair of left and right side walls 5*b* and 5*b*, which face the outer surfaces of the legs of the user, and pneumatic fourth massage portions 12, which perform massage on the legs and are provided at the front surface of the bottom wall 5*a* and the inner surfaces of the side walls 5*b*. The pneumatic second to fourth massage portions 10 to 12 are configured to expand and contract by supply and discharge of air from and to an air supply and discharge apparatus 14 (see FIG. 8), which is arranged under the seat portion 3 and comprises a pump, a valve, and the like, and the driving of the air supply and discharge apparatus 14 is controlled by the control unit 13. In addition, the footrest 5 is coupled to the front portion of the seat portion 3 via hinges 24 in a vertically rotatable manner, coupled to the seat portion 3 (first body supporting portion 20) via the foot link members 50 which will be described later in detail, and configured so as to be vertically rotated in conjunction with the rocking motion of the chair main body 2 in the forward-backward direction. Moreover, the footrest 5 is attached to the seat portion 3 via brackets 25 which are pivotally supported by the hinges 24.

Configuration of Base

As shown in FIGS. 2 to 5, the base 7 includes a pair of leg frames 7*a* and 7*a*, which are arranged a predetermined distance apart from each other in a horizontal direction and installed on the floor surface, and a plurality of shafts 7*b* to 7*d*, the axial directions of which corresponds to the horizontal direction, which couple the both leg frames 7*a* and 7*a*. At the back portions of the leg frames 7*a*, casters 26 which roll on the floor surface are provided such that the massage machine 1 can easily be moved while the front portion of the massage machine 1 is lifted. Members constituting the rocking mechanism portion 8 for rocking the chair main body 2 in the forward-backward direction are pivotally supported by the shafts 7*b* to 7*d*. The shafts 7*b* to 7*d* include a first shaft 7*b* which is located at the frontmost position, a second shaft 7*c* which is located at a further back position than the first shaft 7*b*, and a third shaft 7*d* which are located between the first shaft 7*b* and the second shaft 7*c*.

Configuration of Rocking Mechanism Portion

As shown in FIGS. 3 to 5, the rocking mechanism portion 8 is configured mainly by link members 40, which couple the chair main body 2 to a base 7 such that the chair main body 2 can be rocked in the forward-backward direction, and a rocking drive unit 60 which rocks the link members 40. Each of the link member 40 includes a first link portion 42 and a second link portion 43, which are provided so as to extend upward from the base 7 with a predetermined interval in the forward-backward direction, the lower portions thereof being pivotally supported by the base 7, and the upper portions thereof pivotally supporting the chair main body 2. More specifically, the lower portion of the first link portion 42 is pivotally supported by the first shaft 7*b*, the upper portion thereof pivotally supports the seat portion 3 (chair main body 2) via the bracket 44 and a pivot A1, and the upper portion thereof is configured to be able to be rocked in the forward-backward direction. The lower portion of the second link portion 43 is pivotally supported by the second shaft 7*c* at a position which is further back than the first link portion 42, the upper portion thereof pivotally supports the seat portion 3 (chair main body 2) via the bracket 44 and a pivot A2, and the upper portion thereof is configured to be able to be rocked in the forward-backward direction.

Since the chair main body 2 is supported by the base 7 via the first link portions 42 and the second link portions 43 which are provided with the predetermined intervals as described above, the load (load from the user) working on the rocking mechanism portion 8 is distributed in the forward-backward direction as shown in FIG. 7, and it is possible to stably rock the chair main body 2 in the forward-backward direction. In addition, since the lower portion of the link member 40 is coupled to the base 7, and the upper portion thereof is coupled to the chair main body 2, it is not necessary to locate the coupling portions of the link members 40 in the base 7 (that is, the first shaft 7*b* and the second shaft 7*c*) at a position which is higher than the floor surface, and it is possible to suppress the height of the entire massage machine 1. Moreover, the chair main body 2 includes the containing portion 23, as shown in FIGS. 2 to 4, to locate the brackets 44 which are for attaching the link members 40 to the chair main body 2 and a part (upper portion) of the link members 40 configuring the rocking mechanism portion 8 within the containing portion 23 thereby not to expose such components to the outside of the chair main body 2, and therefore, it is possible to enhance aesthetic appearance of the massage machine 1.

As shown in FIGS. 5 and 6, the rocking drive unit 60 includes a motor 61, a decelerator 62 which decelerates a rotation frequency of the motor 61, and converters 63 which convert the rotation of an output shaft 67*a* of the decelerator 62 to reciprocation of the link members 40 and the chair main body 2 in the forward and backward direction. In addition, the drive of the motor 61 of the rocking drive unit 60 is controlled by the control unit 13. The decelerator 62 will be described more specifically. The decelerator 62 includes a worm 64 provided at the output shaft of the motor 61, a two-stage gear 65 (a combination of a screw gear 65*a*, which is engaged with the worm 64, and a spur gear 65*b*), a two-stage gear 66 (a combination of a spur gear 66*a*, which is engaged with the spur gear 65*b*, and a spur gear 66*b*), and a spur gear 67, which is engaged with the spur gear 66*b*. The rotation center of the two-stage gear 65 coincides with the axial center of the output shaft 67*a*, the two-stage gear 66 is axially supported at a side surface of a gear case 72 (see FIGS. 2 to 4) in a rotatable manner, and the spur gear 67 is attached to the output shaft 67*a*.

The converters 63 are coaxially provided with the output shaft 67*a* of the decelerator 62 (spur gear 67), that is, the converters 63 are attached to the output shaft 67*a*, and each converter 63 includes a rotational member 68 which can be integrally rotated with the output shaft 67*a*, an eccentric shaft 69 attached to the rotational member 68, and a crank member 70 provided between the eccentric shaft 69 and the base 7. The rotational member 68 rotates about a center line C1 when the output shaft 67*a* rotates about the center line C1 and the rotational force thereof is delivered. The eccentric shaft 69 is attached to the rotational member 68 about an axis C2 which is eccentric with respect to the rotational center C1 of the rotational member 68. In addition, one end of the crank member 70 is rotationally attached to the eccentric shaft 69, and the other end thereof is rotationally attached to the third shaft 7*d*. Moreover, the output shaft 67*a* is provided so as to extend in the horizontal direction, and the first link portions 42 and 42 are coupled to each other at both left and right ends thereof.

According to such a configuration of the converters 63, the output shaft 67*a* of the decelerator 62 and the rotational member 68 sequentially rotate in one direction when the motor 61 sequentially rotates in one direction. In so doing, the eccentric shaft 69 on the rotational member 68 performs circular motion about the rotation center C1, and the crank member 70 converts the circular motion into reciprocation of the link member 40 in the forward-backward direction. That is, the converters 63 configure a reciprocation crank mechanism, and it is possible to sequentially and forcibly reciprocate and rock the chair main body 2 in the forward-backward direction while an angle of a seating face of the seat portion 3 is changed, by causing the motor 61 to sequentially rotate in one direction. Such converters 63 are provided as a pair on the left and right sides, which makes it possible to stably rock the chair main body 2.

As shown in FIG. 5, the rocking drive unit 60 is attached to the link members 40. Specifically, the motor 61 and the decelerator 62 are attached to a first link portion 42 on any one side of the left and right sides (the right side in this embodiment) and configured to move along with the first link portion 42. The converters 63 are respectively attached to each of the pair of first link portion 42. A plurality of (three in this embodiment) detected objects 71*b* made of magnetic or the like are provided at the output shaft 67*a* of the decelerator 62, and a detector 71*a* made of a Hall IC or the like which detects a rotation position of the output shaft 67*a* by detecting the positions of the detected objects 71*b* is provided at a cover member (not shown) covering the decelerator 62. The detector 71*a* and the detected objects 71*b* configure a position detecting sensor 71 which detects the rocking position of the chair main body 2 with respect to the base 7. The position detecting sensor 71 is electrically connected to the control unit 13, and the control unit 13 is configured to control the drive of the motor 61 in accordance with a detection result of the position detecting sensor 71.

According to this embodiment, it is possible to detect a standing state (a state shown in FIG. 7(*a*)) in which the chair main body 2 is in a most standing state, a reclining state (a state shown in FIG. 7(*c*)) in which the chair main body 2 is in the most reclined state, and an intermediate state (a state shown in FIG. 7(*b*)) in which the chair main body 2 is positioned between the standing state and the reclining state, as shown in FIG. 7, by detecting the positions of the three detected objects 71*b*. In addition, the state of the chair main body 2 is sequentially changed between the standing state and the reclining state via the intermediate state by sequentially driving the motor 61 in one direction, and the chair main body 2 is positioned at an arbitrary position between the standing state and the reclining state by stopping the motor 61.

In addition, as shown in FIG. 8, the aforementioned rocking drive unit 60 (motor 61) and the massage portions 9 to 12 can be operated based on a signal input to the control unit 13 by the person to be treated controlling a remote controller 75 connected to the control unit 13 as well as based on a program preset in accordance with an instruction from the control unit 13.

Configuration of Foot Link Member

As shown in FIGS. 3 and 4, each of the foot link members 50 includes a first foot link portion 51 which is pivotally supported by the chair main body 2 via the bracket 44, a second foot link portion 52 which is pivotally supported by the first link portion 42 and the first foot link portion 51, and a third foot link portion 53 which is pivotally supported by the second foot link portion 52 and the bracket 25. The upper portion of the first foot link portion 51 is attached to the bracket 44 (namely, the seat portion 3) via a pivot A3 between the pivots A1 and A2, and the lower portion thereof is attached to the back portion of the second foot link portion 52 via a pivot A4. The front portion of the second fool link portion 52 is attached to the third foot link portion 53 via a pivot A5 and attached to the first link portion 42 via a pivot A6 between the pivots A4 and A5. The upper portion of the third fool link portion 53 is attached to the bracket 25 (namely, the footrest 5) via a pivot A7, and the lower portion thereof is attached to the second foot link portion 52 via the pivot A5.

When the first link portions 42 are rocked forward about the first shaft 7*b* and made to approach the reclining state from the standing state, the first foot link portions 51 are rocked in the back direction about the pivot A3, the front portion of the second foot link portion 52 is rocked upward about the pivot A6 with respect to the first link portion 42, and the third foot link portion 53 is rocked downward about the pivot A5. Therefore, when the chair main body 2 is rocked forward and made to approach the reclining state, the footrest 5 is turned upward. More specifically, the seat portion 3 is reclined and the footrest 4 is elevated in the course in which the chair main body 2 is shifted from the standing state to the reclining state. On this occasion, the legs are stretched as they move to a higher position, and therefore, it is possible to promote blood flow to be directed from toes to the heart as in a so-called centripetal method and thereby to enhance a relaxing effect.

On the other hand, when the first link portions 42 is rocked backward about the first shaft 7*b* and made to approach the standing state from the reclining state, the first foot link portion 51 is rocked to the front direction about the pivot A3, the front portion of the second foot link portion 52 is rocked downward about the pivot A6 with respect to the first link portion 42, and the third foot link portion 53 is rocked upward about the pivot A5. Therefore, when the chair main body 2 is rocked backward and made to approach the standing state, the footrest 5 is turned downward. Since the footrest 5 is lowered when the chair main body 2 is in the standing state, the user can easily sit down on and stand up from the chair main body 2.

2. Second Embodiment

Hereinafter, description will be given of a massage machine 100 according to a second embodiment of the present invention with reference to the FIG. 9 and FIG. 10.

Figure 9:
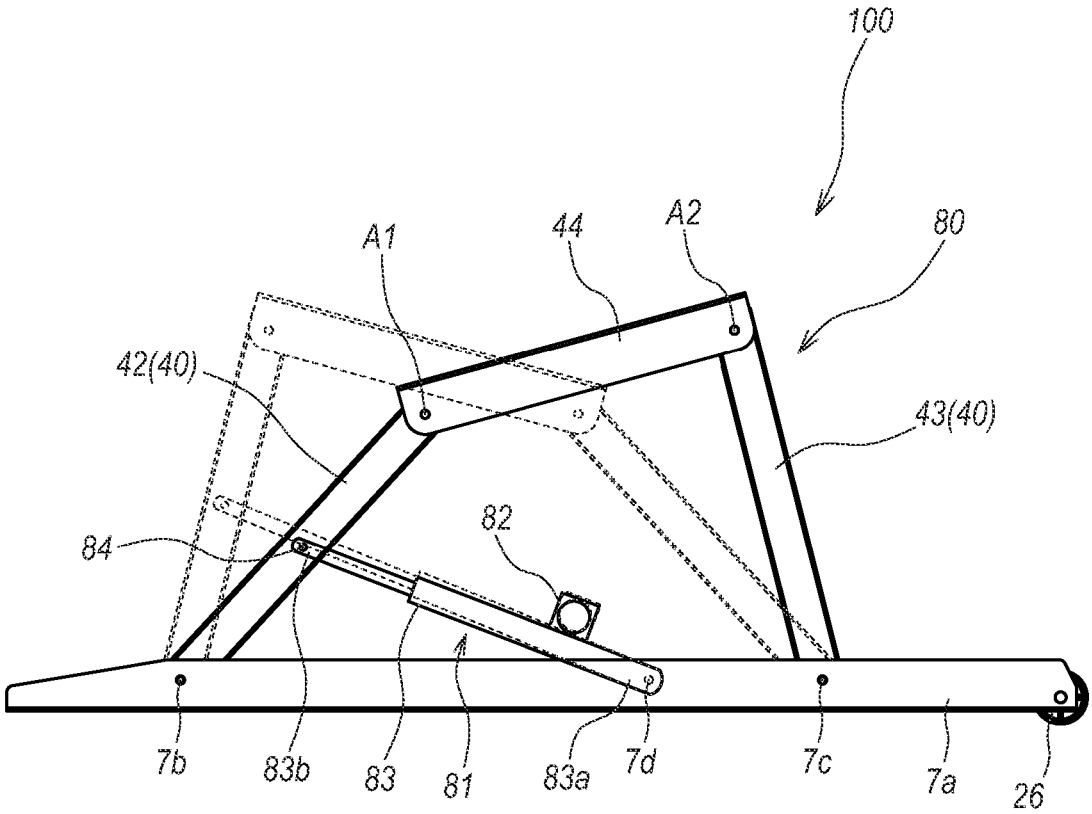
FIG. 9 is a side view showing a base and a rocking mechanism portion of a massage machine.
Figure 10:
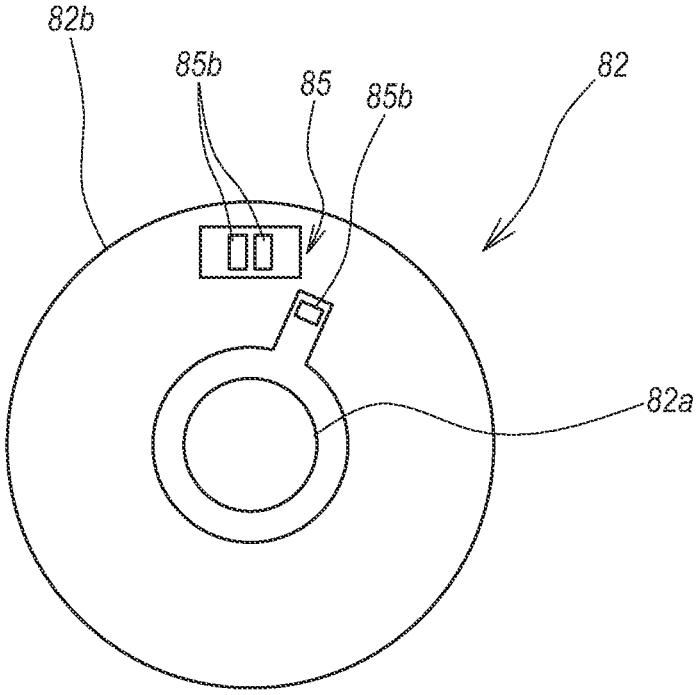
FIG. 10 is a side view showing a motor of a rocking drive unit.

FIG. 9 is a side view showing a base 7 and a rocking mechanism portion 80 of the massage machine 100 according to the second embodiment of the present invention. FIG. 10 is a side view showing a motor 82 of a rocking drive unit 81. The same reference numerals are given to components that are the same as those in the massage machine 1 according to the aforementioned first embodiment, and the description thereof will be omitted. In addition, the configuration of the chair main body 2 is the same as that in the massage machine 1 according to the first embodiment. The massage machine 100 according to the second embodiment is different from that in the first embodiment in a configuration of the rocking mechanism portion 80. Specifically, the rocking mechanism portion 80 is configured mainly by link members 40 which couple the chair main body 2 to the base 7 such that the chair main body 2 can be rocked in the forward-backward direction, and the rocking drive units 81 which rock the link portion 40 members.

Each rocking drive unit 81 is configured by a direct acting type actuator including a motor 82, a cylinder 83 which is driven by the motor 82 to extend and contract. In the rocking drive unit 81, the base portion 83*a* is attached in a turnable manner by the third shaft 7*d* (pivot) of the base 7, and the leading end 83*b* is attached to the first link portion 42 (link member 40) in a rotatable manner by a pivot 84. With such a configuration, it is possible to rock the link members 40 forward as shown by a one-dotted chain line and shift the chair main body 2 to the reclining state when the rocking drive unit 81 is elongated, and it is possible to rock the link members 40 backward as shown by a solid line and shift the chair main body 2 to the standing state when the rocking drive unit 81 is shortened.

The rocking drive unit 81 includes a position detecting sensor 85 which detects the rocking position of the chair main body 2 with respect to the base 7. The position detecting sensor 85 is configured by detected objects 85*b* made of a magnet or the like which are attached to an output shaft 82*a* of the motor 82 and detectors 85*a* made of Hall ICs or the like which are provided at a motor main body 82*b* for detecting the passing of the detected objects 85*b* so as to be able to detect an arbitrary rocking position between the standing state and the reclining state of the chair main body 2 by the detectors 85*a* detecting the number of rotations of the output shaft 82*a* (motor 82). Moreover, two detectors 85*a* are provided so as to be adjacent to each other in a circumferential direction of the output shaft 82*a* and can also detect the rotation direction of the output shaft 82*a* (motor 82) by determining which detector 85*a* has detected the passing of the detected object 85*b* earlier. The position detecting sensor 85 is electrically connected to the control unit 13, and the control unit 13 is configured to control the drive of the motor 82 in accordance with a detection result of the position detecting sensor 85.

In addition, the massage machine of the present invention is not limited to the configurations shown in the drawings, and other configurations are also applicable within the scope of the present invention. For example, a biasing member made of a spring (tension spring), a damper, or the like may be provided which is attached between the base 7 and the first link portion 42 (link member 40) instead of the rocking drive unit 60 or 81 so as to bias the chair main body 2 to the standing state, in the rocking mechanism portion. In such a case, the chair main body 2 can be maintained in the standing state by the biasing force of the biasing member, and the backrest portion 4 can be brought to be in the reclining state when the user seated on the seat portion 3 leans on the backrest portion 4. Then, when the user weakens the force of leaning on the backrest portion 4, the backrest portion 4 in the reclining state can be recovered to the standing state by the biasing force of the biasing member.

DESCRIPTION OF REFERENCE NUMERALS AND SIGNS

1: MASSAGE MACHINE
2: CHAIR MAIN BODY
3: SEAT PORTION
4: BACKREST PORTION
5: FOOTREST
7: BASE
8: ROCKING MECHANISM
9 TO 12: MASSAGE PORTION
23: CONTAINING PORTION
40: LINK MEMBER
42: FIRST LINK PORTION
43: SECOND LINK PORTION
50: FOOT LINK MEMBER
60: ROCKING DRIVE UNIT
61: MOTOR
62: DECELERATOR
63: CONVERTER
67*a*: OUTPUT SHAFT
68: ROTATIONAL MEMBER
69: ECCENTRIC SHAFT
70: CRANK MEMBER
80: ROCKING MECHANISM PORTION
81: ROCKING DRIVE UNIT
100: MASSAGE MACHINE

What is claimed is:

1. A massage machine comprising:

a chair assembly including a chair main body having a seat portion on which a user can be seated and a back rest portion which is provided behind the seat portion;

a base that supports the chair main body;

a massage portion which is provided in the chair main body configured to be able to perform massage on a body of the user; and a rocking mechanism portion which rocks the chair main body in a forward-backward direction with respect to the base, the rocking mechanism portion includes a telescopic cylinder device, a first link and a second link, the first link pivotably connected at one end to a base forward portion of the base and at an opposite end to a chair forward portion of the chair assembly, the second link pivotably connected at one end to a base rearward portion of the base and at an opposite end to a chair rearward portion of the chair assembly, the telescopic cylinder device pivotably connected to the base between the base forward portion and the base rearward portion and pivotably connected at an opposite end to either the first link between the chair forward portion and the base forward portion or the second link between the chair rearward portion and the base rearward portion, wherein the rocking mechanism portion rocks the chair main body in the forward-backward direction with respect to the base as the telescopic cylinder device moves to and between an extended telescopic state and a contracted telescopic state.

2. The massage machine according to claim 1, wherein the chair main body includes an accommodating portion that accommodates at least a part of the rocking mechanism portion inside the chair main body, the first and second link members are attached to the accommodation portion.

3. A massage machine comprising:

a chair main body including a seat portion on which a user can be seated and a back rest portion which is provided behind the seat portion;

a base that supports the chair main body;

a massage portion which is provided in the chair main body configured to be able to perform massage on a body of the user; and a rocking mechanism portion which rocks the chair main body in a forward-backward direction with respect to the base, the rocking mechanism portion includes link members, each of the link members comprises a lower portion pivotally supported by the base and an upper portion pivotally supporting the chair main body, and the chair main body is rocked in the forward-backward direction by rocking the upper portions of the link members in the forward-backward direction, wherein the rocking mechanism portion includes a rocking drive unit that rocks the link members, wherein the rocking drive unit comprises:

a motor, a decelerator that includes an output shaft, the output shaft is rotated by rotation of the motor, and a converter that converts rotational movement of the output shaft into reciprocating rocking motion in the forward-backward direction of the link members, and the converter includes:

a rotational member which is rotatable integrally with the output shaft, an eccentric shaft which is attached to the rotational member, and a crank member which is provided between the eccentric shaft and the base.

4. The massage machine according to claim 3, wherein the chair main body includes a footrest which is provided in front of the seat portion such that the footrest is rotatable in the vertical direction, the chair main body is configured such that a front portion of the seat portion moves upward in conjunction with forward movement and a front portion of the seat portion moves downward in conjunction with backward movement, and the footrest is configured to be rotated upward in conjunction with the forward movement of the chair main body.

5. The massage machine according to claim 4, further comprising:

foot link members that vertically rotate the footrest in conjunction with movement of the chair main body in the forward-backward direction, the footrest is connected to the link members via the foot link members.

6. The massage machine according to claim 5, wherein each of the link members includes a first link portion and a second link portion positioned behind the first link portion.

7. The massage machine according to claim 6, wherein the first link portions are coupled to the rocking drive portion and the second link portions follow movement of the first link portions, and the foot link members are pivotally supported by the first link portions.

8. A massage machine comprising:

a chair main body including a seat portion on which a user can be seated and a back rest portion which is provided behind the seat portion;

a base that supports the chair main body;

a massage portion which is provided in the chair main body configured to be able to perform massage on a body of the user; and a rocking mechanism portion which rocks the chair main body in a forward-backward direction with respect to the base, the rocking mechanism portion includes link members, each of the link members comprises a lower portion pivotally supported by the base and an upper portion pivotally supporting the chair main body, and the chair main body is rocked in the forward-backward direction by rocking the upper portions of the link members in the forward-backward direction, wherein the chair main body includes an accommodating portion that accommodates at least a part of the rocking mechanism portion inside the chair main body, the link members are attached to the accommodation portion, wherein the rocking drive unit includes:

a motor, a decelerator that comprises an output shaft, the output shaft is rotated by rotation of the motor, and a converter which converts rotational movement of the output shaft into reciprocating rocking motion in the forward-backward direction of the link members, and the converter includes:

a rotational member which is rotatable integrally with the output shaft, an eccentric shaft which is attached to the rotational member, and a crank member which is provided between the eccentric shaft and the base.

9. The massage machine according to claim 8, wherein the chair main body includes a footrest which is provided in front of the seat portion such that the footrest is rotatable in the vertical direction, the chair main body is configured such that a front portion of the seat portion moves upward in conjunction with forward movement and a front portion of the seat portion moves downward in conjunction with backward movement, and the footrest is configured to be rotated upward in conjunction with the forward movement of the chair main body.

10. The massage machine according to claim 9, further comprising:

foot link members which vertically rotate the footrest in conjunction with movement of the chair main body in the forward-backward direction, the footrest is connected to the link members via the foot link members.

11. The massage machine according to claim 10, wherein each of the link members includes a first link portion and a second link portion positioned behind the first link portion, the first link portions are coupled to the rocking drive portion and the second link portions follow movement of the first link portions, and the foot link members are pivotally supported by the first link portions.

12. The massage machine according to claim 1, wherein the chair assembly includes a bracket connected to a bottom portion of the chair main body that extends forwardly and rearwardly along the chair assembly and wherein the first link is pivotably connected to the bracket at the chair forward portion and the second link is pivotably connected to the bracket at the chair rearward portion.

* * * * *